US010224618B2

(12) United States Patent
Martínez Ortigosa et al.

(10) Patent No.: US 10,224,618 B2
(45) Date of Patent: Mar. 5, 2019

(54) MIMO ANTENNA SYSTEM FOR A VEHICLE

(71) Applicant: ADVANCED AUTOMOTIVE ANTENNAS, S.L.U., Barecelona (ES)

(72) Inventors: Enrique Martínez Ortigosa, Barcelona (ES); Victor Mata Garcia, Barcelona (ES); Ramiro Quintero Illera, Barcelona (ES)

(73) Assignee: Advanced Automotive Antennas, S.L.U., Barcelona (ES)

( * ) Notice: Subject to any disclaimer, the term of this patent is extended or adjusted under 35 U.S.C. 154(b) by 178 days.

(21) Appl. No.: 15/264,144

(22) Filed: Sep. 13, 2016

(65) Prior Publication Data

US 2017/0077596 A1 Mar. 16, 2017

(30) Foreign Application Priority Data

Sep. 14, 2015 (EP) ..... 15382448

(51) Int. Cl.
*H01Q 21/00* (2006.01)
*H01Q 1/32* (2006.01)
(Continued)

(52) U.S. Cl.
CPC ..... *H01Q 1/3275* (2013.01); *H01Q 1/241* (2013.01); *H01Q 1/36* (2013.01); *H01Q 1/42* (2013.01);
(Continued)

(58) Field of Classification Search
CPC ..... H01Q 1/3275; H01Q 21/00; H01Q 1/241; H01Q 1/48; H01Q 13/10; H01Q 1/32
(Continued)

(56) References Cited

U.S. PATENT DOCUMENTS 7,868,834 B2 1/2011 Ortigosa
2004/0222923 A1* 11/2004 Erkocevic ..... H01Q 1/243 343/700 MS
(Continued)

FOREIGN PATENT DOCUMENTS

DE 10 2009 038 038 A1 2/2011
WO 2014061317 A1 4/2014

OTHER PUBLICATIONS

Extended European Search Report dated Mar. 29, 2016 from corresponding European Application No. 15382448.7, 7 pages.
(Continued)

*Primary Examiner* — Hai Tran
(74) *Attorney, Agent, or Firm* — Ohlandt, Greeley, Ruggiero & Perle, L.L.P.

(57) ABSTRACT

A MIMO antenna system for a vehicle comprising first and second monopole antennas, which comprises first, second and third conductors. First and second conductors are electrically connected in parallel, and the third conductor is coupled to the first and second conductors. The first conductor has a height (H1) and thickness (t1) such that the H1/t1 ratio is within 5 to 45 to provide a resonant frequency at a first LTE frequency band. The second conductor has a height of 30%-60% H1 to provide a resonant frequency at a second LTE frequency band. The third conductor provides resonant frequencies at third and fourth LTE frequency bands, and having an electrical length such that the coupling level of the third conductor with respect to first and second conductors in the third and fourth LTE frequency bands is greater than 10 dB.

17 Claims, 11 Drawing Sheets

(51) Int. Cl.

| | |
|---|---|
| ***H01Q 1/36*** | (2006.01) |
| ***H01Q 1/42*** | (2006.01) |
| ***H01Q 9/40*** | (2006.01) |
| ***H01Q 9/42*** | (2006.01) |
| ***H01Q 5/371*** | (2015.01) |
| ***H01Q 5/378*** | (2015.01) |
| ***H01Q 5/50*** | (2015.01) |
| ***H01Q 1/24*** | (2006.01) |
| ***H01Q 1/48*** | (2006.01) |

(52) U.S. Cl.
CPC ..... *H01Q 1/48* (2013.01); *H01Q 5/371* (2015.01); *H01Q 5/378* (2015.01); *H01Q 5/50* (2015.01); *H01Q 9/40* (2013.01); *H01Q 9/42* (2013.01); *H01Q 21/00* (2013.01)

(58) Field of Classification Search
USPC ..... 343/770, 713
See application file for complete search history.

(56) References Cited

U.S. PATENT DOCUMENTS

| | | | | |
|---|---|---|---|---|
| 2011/0109513 | A1 | 5/2011 | Yamaki | |
| 2013/0135164 | A1* | 5/2013 | Asanuma | H01Q 7/00 343/749 |
| 2013/0141297 | A1 | 6/2013 | Gommé et al. | |
| 2013/0154890 | A1* | 6/2013 | Jan | H01Q 1/521 343/770 |
| 2015/0109182 | A1 | 4/2015 | Hen et al. | |
| 2015/0280316 | A1 | 10/2015 | Iso | |
| 2016/0352014 | A1* | 12/2016 | Chen | H01Q 1/243 |

OTHER PUBLICATIONS

Extended European Search Report dated Jan. 25, 2017 from corresponding European Application No. 15382448.7, 7 pages.

* cited by examiner

MIMO ANTENNA SYSTEM FOR A VEHICLE

OBJECT OF THE INVENTION

The present invention relates to a new design of an antenna system, specifically designed for being installed on a vehicle, and in particular, for operating on the LTE network. This new antenna is also designed for being capable of integrating different antennas to provide additional communication services.

One object of this invention is to provide an antenna system capable of reducing the size of existing antenna systems for vehicles, in order to ease the integration of all radio-communication services on the vehicle in a single compact antenna module.

Another object of this invention is to provide an antenna system capable of covering all the 4G frequency bands, ensuring at the same time isolation between the LTE antennas, despite the distance reduction between them.

BACKGROUND OF THE INVENTION

Traditionally, vehicles have been provided with antennas mounted in different locations of the vehicle. Usually, these antennas were located at the rear window and/or on the roof.

Over the years, the number of radio-communication services has increased and, in consequence, the number of antennas required for providing these services.

Also, aesthetic and aerodynamic trends have changed and, over the years, satisfying customer tastes has become essential in the automotive industry. Lately, customer tastes generally lead to vehicles having a streamlined and smooth appearance, which interfere with providing the vehicle with multiple and dispersed antennas.

Thus, both for meeting customer tastes and providing all the radio-communication services possibly demanded by the driver, the automotive industry is tending to integrate in a single module all the communication modules specifically designed for providing one communication service, such as telephony, AM/FM radio, satellite digital audio radio services (SDARS), global navigation satellite system (GNSS), or digital audio broadcasting (DAB).

The integration of multiple antenna units in a single global antenna module leads to achieve great advantages in costs, quality and engineering development time.

This global antenna module is also conditioned by meeting customer tastes. For that, it would be desirable to reduce the size of the antenna module in order to maintain the streamlined appearance of the vehicle. In particular, it would be desirable to reduce the length of the antenna module to facilitate the integration of other antennas configured for providing other communication services without having to increase the length of the antenna module.

However, a reduction in the length of the antenna module affects its performance, specially, the level of isolation between the two LTE antennas. This reduction in isolation directly affects the LTE communication.

Then, it would be desirable to develop an improved MIMO antenna system for a vehicle that is capable of providing communication at all 4G frequency bands of operation while having a length reduction.

DESCRIPTION OF THE INVENTION

The present invention overcomes the above mentioned drawbacks by providing a new design of an antenna system for a vehicle, which having a reduced length is capable of providing communication at all LTE frequency bands.

In one aspect of the invention, the multiple-input multiple-output (MIMO) antenna system for a vehicle comprises first and second monopole antennas disposed on a dielectric substrate, each monopole antenna extending substantially perpendicular to the dielectric substrate, and each monopole antenna comprising first, second and third conductors. The first and second conductors have an elongated shaped and are electrically connected in parallel to each other, while the third conductor is electromagnetically coupled to the first and second conductors. The first conductor has a height and a thickness such that the height to thickness ratio is comprised within 5 to 45 so as to provide a resonant frequency at a first LTE frequency band. The second conductor has a height of 30%-60% of the height of the first conductor to provide a resonant frequency at a second LTE frequency band. And, the third conductor is electromagnetically coupled to the first and second conductors to thereby provide additional resonant frequencies at third and fourth LTE frequency bands and having an electrical length such that an S21 parameter measured as a level of electromagnetic coupling of the third conductor to the first and second conductors in the third and fourth LTE frequency bands is less than −10 dB.

The first conductor is provided with a configuration suitable for maximizing the radiation of the antenna at a first LTE frequency band. For that, the first conductor is elongated such that it can be circumscribed by an imaginary parallelepiped whose height to thickness ratio is within the range 5 to 45. Preferably, the first LTE frequency band of operation corresponds to a frequency band ranging from 825 MHz to 960 MHz.

The second conductor is electrically connected in parallel to the first conductor to provide a resonant frequency at a second LTE frequency band. The second conductor is elongated such that it can be circumscribed by an imaginary parallelepiped having a height of 30%-60% of the height of the first conductor. Providing this height to the second conductor, said second conductor is configured to operate at about a double frequency of the first conductor. Preferably, the second LTE frequency band of operation corresponds to a frequency band ranging from 1710 MHz to 2100 MHz.

The third conductor is electromagnetically coupled to the first and second conductors in a manner such that the third conductor provides through this electromagnetic coupling additional resonant frequencies at third and fourth LTE frequency bands. The third conductor is configured to have an electrical length that results in an S21 parameter measured as a level of electromagnetic coupling to the first and second conductors, in the third and fourth LTE frequency bands being less than −10 dB. In this way, the third conductor is capable of providing additional resonant frequencies at third and fourth LTE frequency bands, while, at the same time, a reduction in the length of the antenna is achieved without affecting the performance of the antenna, and in particular, without affecting the level of isolation between the two monopole antennas. Preferably, the third LTE frequency band of operation corresponds to a frequency band ranging from 700 to 800 MHz. Also preferably, the fourth LTE frequency band of operation corresponds to a frequency band ranging from 2500 to 2700 MHz.

With this configuration, an increase in bandwidth is achieved with respect to conventional MIMO antenna systems. Furthermore, the distance between the first and second monopole antennas can be reduced, avoiding that the change of isolation between said monopole antennas affects the communication in any of the 4G frequency bands of operation.

In this way, the MIMO antenna system achieves about a 10% reduction in the distance between the monopole antennas with respect to the conventional distance between monopole antennas.

Despite the distance reduction between the first and second monopole antennas, the configuration of the MIMO antenna system achieves maintaining the monopole antennas uncorrelated, with isolation between antennas above 10 dB. This level of isolation between antennas allows the MIMO antenna system to have an optimum MIMO functionality at any frequency band.

The antenna system of the invention achieves providing communication at the lower 4G frequencies (LTE 700/LTE 800). In this way, the invention improves conventional compact solutions, which, while having a distance between LTE antennas of about 100 mm, their lower 4G frequencies coverage exceeds 800 MHz.

In a preferred embodiment, a MIMO antenna system of the invention further comprises at least one electric or electronic component, in particular, a camera, where said electric component is located at a null of the radiation pattern of the antenna system. Thus, the invention avoids the need for shielding the radio emissions of the antenna or the electric or electronic component, to ensure proper component operation.

Further, locating a camera on top of a vehicle provides an optimal point of view because the height achieved maximizes the viewing angle.

In another aspect of the invention, a shark fin antenna comprises the MIMO antenna system of the invention and a cover for enclosing said MIMO antenna system.

Integrating a camera into a shark fin antenna allows slightly raising the height of the camera, easing its mounting on a vehicle, making the vehicle more compact.

BRIEF DESCRIPTION OF THE DRAWINGS

For a better comprehension of the invention, the following drawings are provided for illustrative and non-limiting purposes, wherein:

FIG. 2*b* further shows a graphic showing the coupling level between the conductors.

PREFERRED EMBODIMENTS OF THE INVENTION

Figure 1:
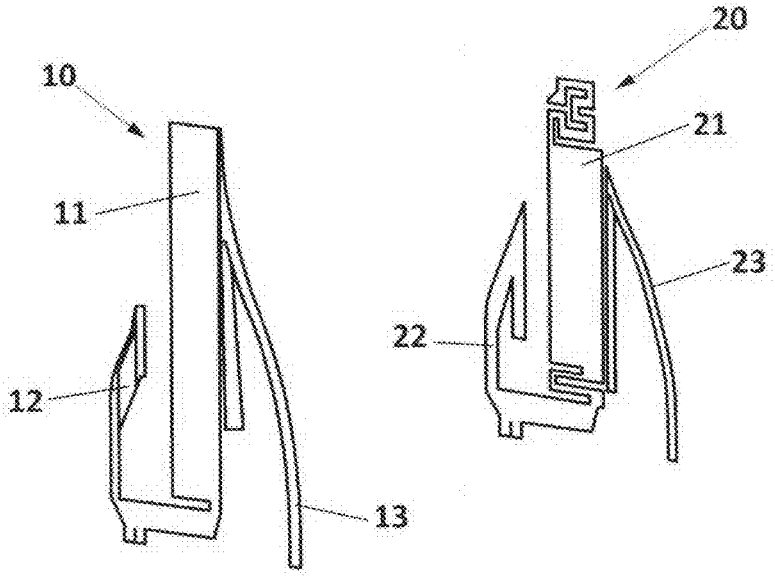
FIG. 1 shows perspective views of the first and second monopole antennas of the MIMO antenna system, according to a first embodiment of the invention.

FIG. 1 shows first 10 and second 20 monopole antennas according to a first embodiment of the MIMO antenna system of the invention. As shown, each monopole antenna 10, 20 comprises first 11, 21, second 12, 22 and third conductors 13, 23. The first 11, 21 and second 12, 22 conductors have an elongated shaped and are electrically connected in parallel to each other. The third conductor 13, 23 is electromagnetically coupled to the first 11, 21 and second conductors 12, 22, and has, preferably, a crooked shape.

Figure 2A:
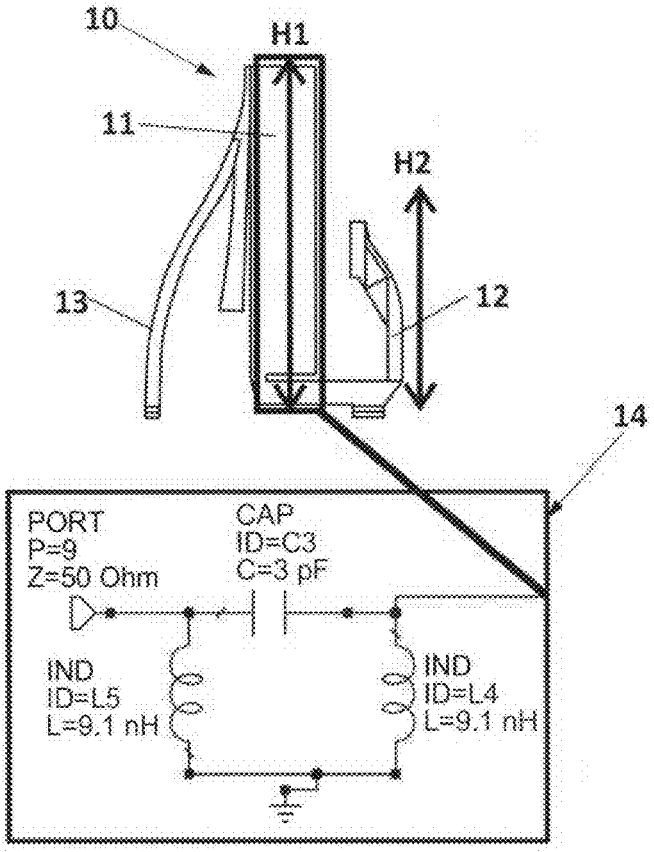
FIGS. 2*a* and 2*b* show front views of one of the monopole antennas of the MIMO antenna system in which the height of the first and second conductors and the electric length of the third conductor are specified.

FIG. 2*a* shows a front view of the first 10 monopole antenna shown in FIG. 1. As shown, the first 11 and second conductors 12 are elongated having respective height dimensions H1, H2. Preferably, the first conductor 11 maximizes the radiation of the antenna in the band of 825-960 MHz, corresponding to the first LTE frequency band of operation. To that end, the first conductor 11 is dimensioned with a height H1 about $\lambda/4$, being $\lambda$ the operating frequencies. Also, in order to obtain an appropriate bandwidth, the first conductor 11 has to meet certain thickness t1 values. Preferably, thickness t1 value is about 2 mm to obtain an optimum bandwidth. Height to thickness ratios H1/t1 between 5 to 45 obtain an optimum antenna performance. Preferably, the height to thickness ratio H1/t1 will be comprised within 10 to 35.

The second conductor 12 is connected in parallel to the first conductor 11. Since the height H2 of the second conductor 12 is 30%-60% of the height H1 of the first conductor 11, the second conductor 12 is configured to have a resonant frequency about the double of the first conductor 11. In this way, the second conductor 12 provides a resonant frequency at the second LTE frequency band. Preferably, the second LTE frequency band of operation corresponds to a frequency band ranging from 1710 MHz to 2100 MHz. Thus, the monopole antennas 10, 20 cover high frequency bands.

In a preferred embodiment, the height H2 of the second conductor 12 is 40%-50% of the height H1 of the first conductor 11.

In another preferred embodiment, the MIMO antenna system further comprises an LC network 14 connected to the first and second conductors 11, 12; 21, 22 to adjust the MIMO antenna system 1 frequency operation. As shown in FIG. 2*a*, the LC network 14 is preferably connected to a common feeding point of the first 11 and second 12 conductor.

Figure 2B:
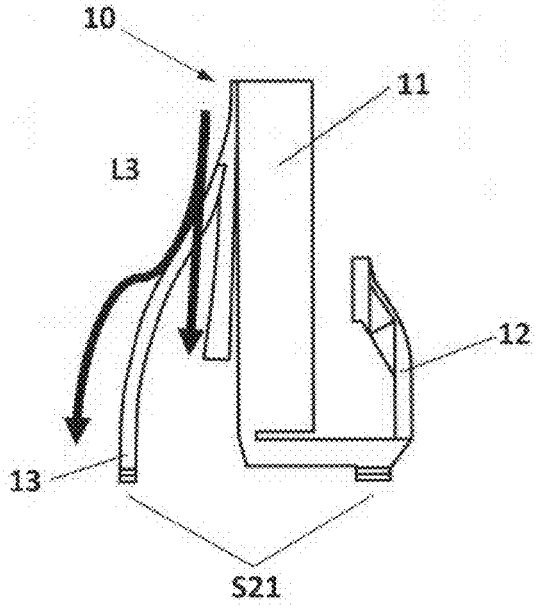

FIG. 2*b* shows a third conductor 13 electromagnetically coupled to the first 11 and second conductors 12 to thereby provide additional resonant frequencies at third and fourth LTE frequency bands. The third conductor 13 has an electrical length L3 such that an S21 parameter measured as a level of electromagnetic coupling to the first 11 and second conductors 12 in the third and fourth LTE frequency bands is less than −10 dB.

Preferably, the third LTE frequency band of operation corresponds to a frequency band ranging from 700 to 800 MHz, and the fourth LTE frequency band of operation corresponds to a frequency band ranging from 2500 to 2700 MHz. With this third conductor 13, the antenna system 1 is capable of providing communication at the low end frequency of 700 MHz and at the high end frequency of 2700 MHz.

FIG. 2*b* further shows a graphic showing the coupling level between the third 13 and both the first 11 and second conductors 12. As shown, the coupling level S21 is less than −10 dB in the third and fourth LTE frequency bands of operation.

Figure 3:
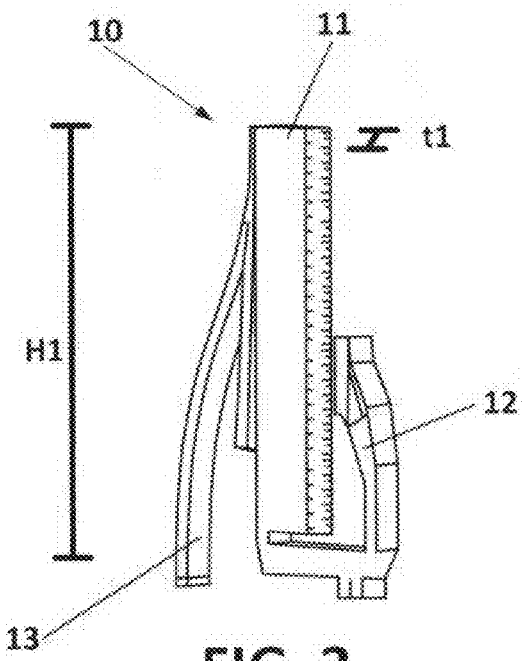
FIG. 3 shows a perspective view of one of the monopole antennas of the MIMO antenna system, according to the first embodiment of the invention.
Figure 4:
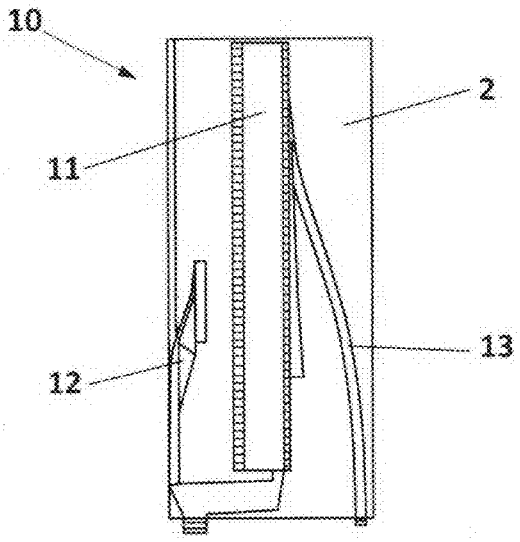
FIG. 4 shows a perspective view of one of the monopole antennas of the MIMO antenna system, according to a second embodiment of the invention.

FIGS. 3 and 4 show a perspective view of the first monopole antenna 10, according to a first and second embodiment. In both embodiments, the height to thickness ratio H1/t1 of the first conductor 11 is comprised within 5 to 45. In the first embodiment, the thickness required for the ratio is achieved by the proper thickness of the conductors, while, in the second embodiment, the thickness is achieved by means of a substrate.

Figure 2B:
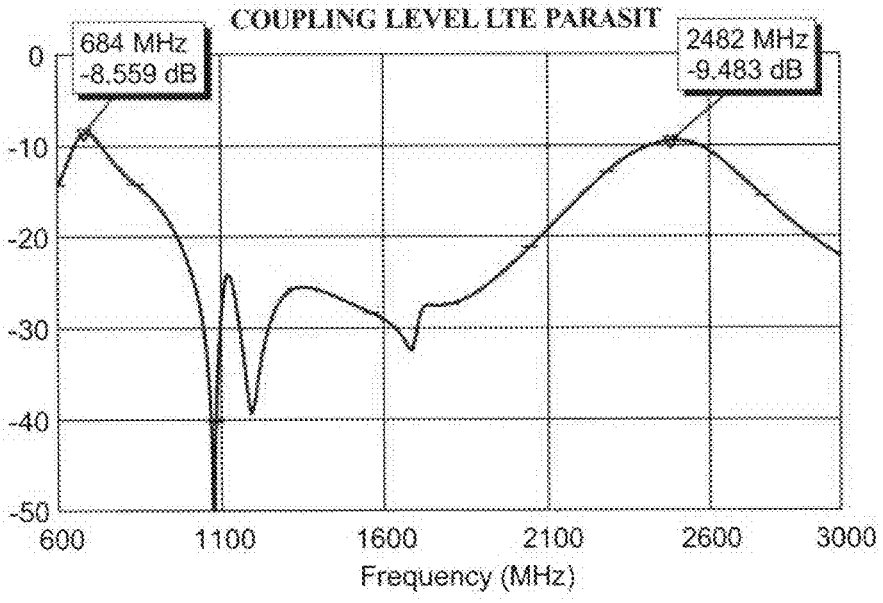

It has to be noted that FIGS. 2 to 4 show a first monopole antenna 10 as an example, however, same above mentioned provisions can be applied to the second monopole antenna 20 of the MIMO antenna system.

In a preferred embodiment, at least one of the monopole antennas 10, 20 has a longitudinal substrate 2, 3 comprising the first, second and third conductors 11, 12, 13; 21, 22, 23. The second and third conductors 12, 13; 22, 23 are planar and are extended along a first surface 15, 25 of said longitudinal substrate 2, 3. The first conductor 11, 21 comprises a first segment 11*a*, 21*a* extended along the first surface 15, 25 of said longitudinal substrate 2, 3 and a second segment 11*b*, 21*b* extended along a second, opposing surface 16, 26 of said longitudinal substrate 2, 3. The first 11*a*, 21*a* and second segments 11*b*, 21*b* are connected through a plurality of vias 19, 29 arranged at the periphery of said segments 11*a*, 11*b*; 21*a*, 21*b* to provide a desired thickness t1 to the first conductor 11, 21.

Figure 5A:
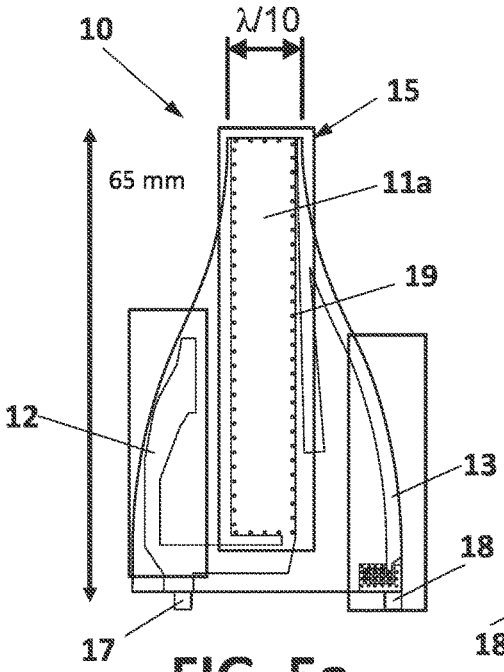
FIGS. 5*a* and 5*b* show perspective views, respectively, of the front side and the back side of the first monopole antenna, according to the second embodiment of the invention.
Figure 5B:
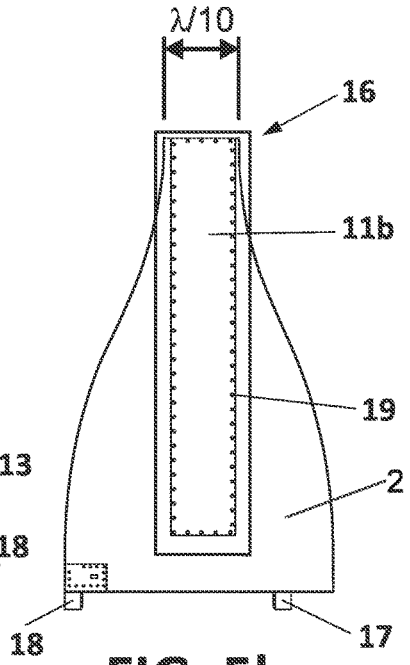

FIGS. 5*a* and 5*b* show, respectively, the first surface 15 and the second opposing surface 16 of the first monopole antenna 10. The first surface 15 corresponds to the front side of the first monopole antenna 10, and the second surface 16 corresponds to its back side. The front side is mounted on the dielectric substrate 5 so as to radiate towards the exterior of the antenna system 1, and the back side to radiate towards the interior. Thus, the back side of the first monopole antenna 10 faces the back side of the second monopole antenna 20.

Figure 6A:
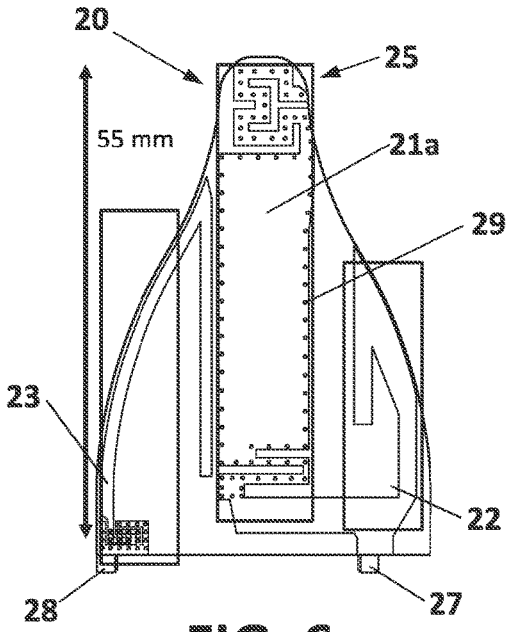
FIGS. 6*a* and 6*b* show perspective views, respectively, of the front side and the back side of the second monopole antenna, according to the second embodiment of the invention.
Figure 6B:
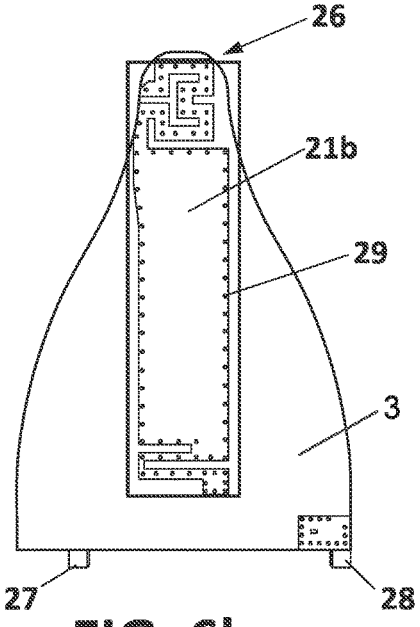

Likewise, FIGS. 6*a* and 6*b* show, respectively, the first surface 25 and the second surface 26 of the second monopole antenna 20. The first surface 25 corresponds to the front side of the second monopole antenna 20, and the second surface 26 corresponds to its back side.

According to another preferred embodiment, the distance between the vias 19, 29 of each first and second segments 11*a*, 11*b*; 21*a*, 21*b* is less than λ/10, where λ is defined by the operation frequency of the first LTE frequency band.

According to another preferred embodiment, the first and second monopole antennas 10, 20 have a substantially identical configuration.

Preferably, the first and second segments 11*a*, 11*b*; 21*a*, 21*b* have a rectangular shape extended along the major part of the longitudinal dimension of the longitudinal substrate 2, 3.

Preferentially, each one of the first and second monopole antennas 10, 20 have a feeding end 17, 27 and a grounding end 18, 28 for coupling the antennas 10, 20 to the dielectric substrate 5. In this case, the MIMO antenna system 1 further comprises first and second feeding points formed on the dielectric substrate 5, and first and second grounding points formed on the dielectric substrate 5, so that the feeding end 17, 27 of the first and second monopole antennas 10, 20 is coupled to a respective one of said first and second feeding points, and the grounding end 18, 28 of the first and second monopole antennas 10, 20 is coupled to a respective one of said first and second grounding points.

Preferentially, the feeding end 17, 27 is arranged at one extreme of the second conductor 12, 22, and the grounding end 18, 28 at one extreme of the third conductor 13, 23.

Each one of the monopole antenna 10, 20 extends substantially perpendicular to the dielectric substrate 5. According to a preferred embodiment, the first and second monopole antennas 10, 20 are disposed on the dielectric substrate 5 such that an imaginary axis passing along the center of the first conductors 11, 21 of the first and second monopole antennas 10, 20 are parallel to each other.

According to this, the first and second monopole antennas 10, 20 can be disposed in different ways in the dielectric substrate 5.

FIG. 7 shows different options of disposing the first and second monopole antennas 10, 20 on the dielectric substrate 5 of the MIMO antenna system.

Figure 7A:
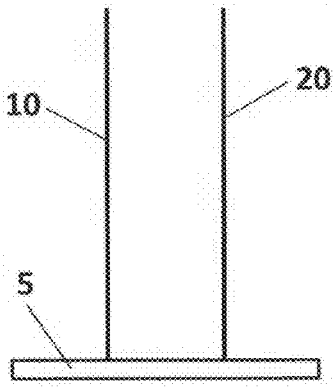
FIGS. 7*a*, 7*b*, 7*c* and 7*d* show different options for disposing the first and second monopole antennas on the dielectric substrate of the MIMO antenna system.
Figure 7B:
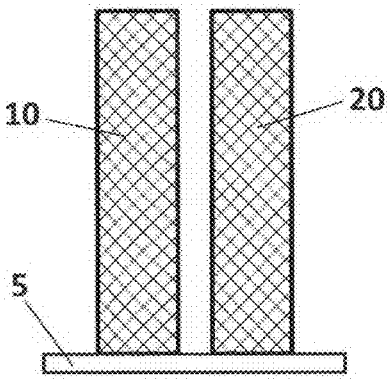
Figure 7C:
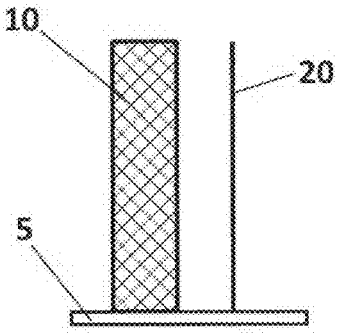
Figure 7D:
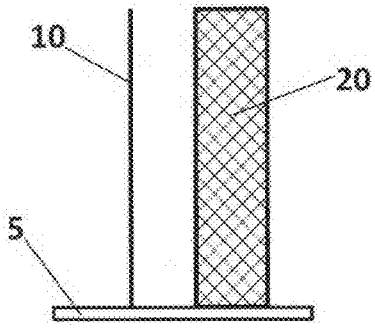

In a first option, shown in FIG. 7*a*, the first and second monopole antennas 10, 20 are parallel to each other, but not coplanar. In a second option, shown in FIG. 7*b*, the first and second monopole antennas 10, 20 can be parallel to each other and coplanar. In a third option, shown in FIGS. 7*c* and 7*d*, the first and second monopole antennas 10, 20 can be perpendicular to each other.

According to a preferred embodiment, the distance between the first and second monopole antennas 10, 20 is comprised within 80 and 110 mm, and preferentially, said distance is about 90 mm. The configuration of the MIMO antenna system 1 of the invention achieves to reduce its length in about 10% with respect to conventional MIMO antenna systems. Thus, the invention achieves meeting both aesthetic and aerodynamic requirements that the automotive industry must comply with, while at the same time provides communication in all LTE frequency bands.

Preferentially, the height of the first and second monopole antennas 10, 20 of the MIMO antenna system 1 is less than 65 mm.

According to another preferred embodiment, the first conductor 11, 21 of at least one of the first and second monopole antennas 10, 20 is shaped as a space-filling curve at an extreme portion of the first and second segments 11*a*, 11*b*; 21*a*, 21*b*. In this case, the height of the at least one of the first and the second monopole antennas 10, 20 can be less than 55 mm.

For purposes of describing this invention, space-filling curve should be understood as defined in U.S. Pat. No. 7,868,834B2, in particular, in paragraphs [0061]-[0063], and FIG. 10.

Figure 8:
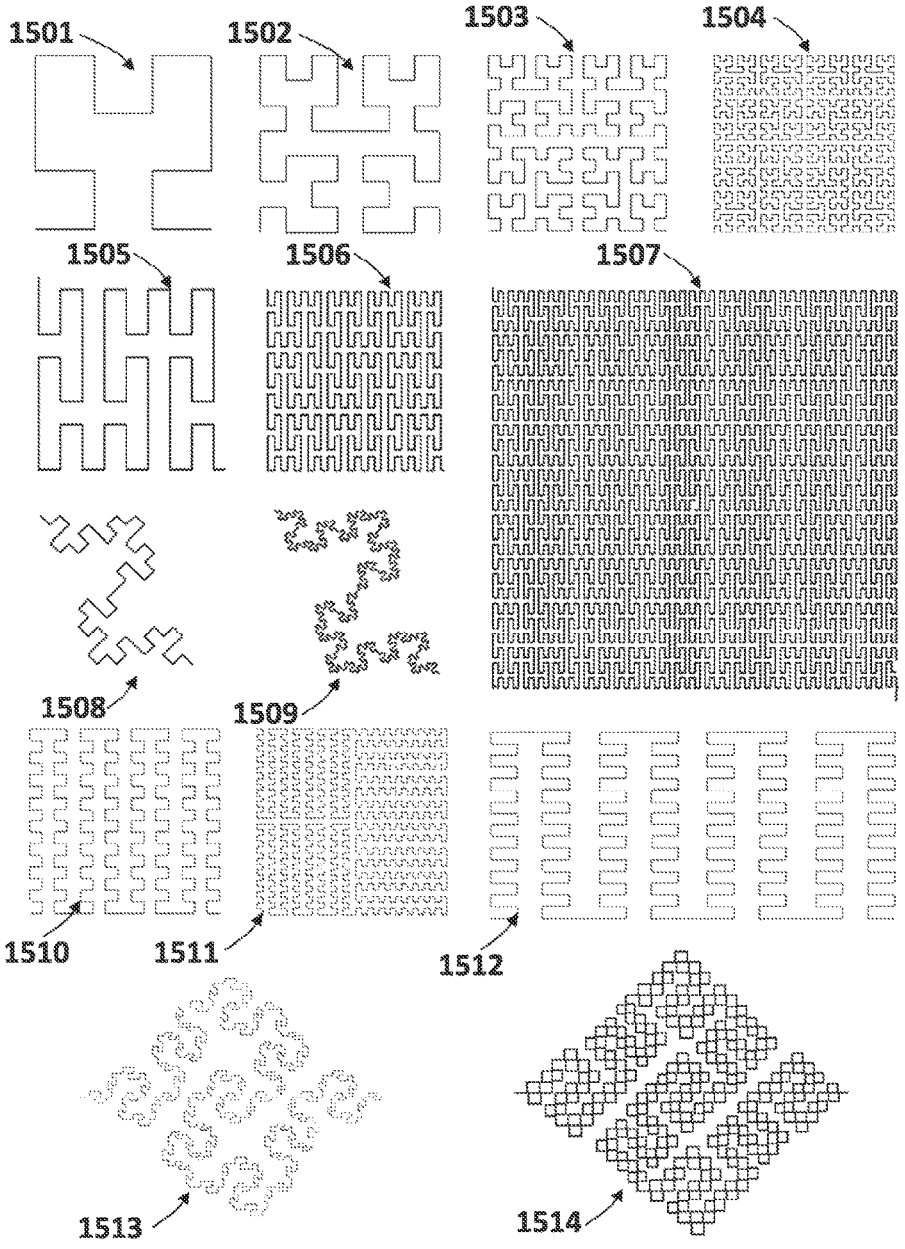
FIG. 8 shows examples of space-filling curves.

One or more of the antenna elements described herein may be miniaturized by shaping at least a portion of the antenna element to include a space-filling curve. FIG. 8 shows examples of space-filling curves. Space-filling curves 1501 through 1514 are examples of space filling curves for antenna designs. Space-filling curves fill the surface or volume where they are located in an efficient way while keeping the linear properties of being curves.

A space-filling curve is a non-periodic curve including a number of connected straight segments smaller than a fraction of the operating free-space wave length, where the segments are arranged in such a way that no adjacent and connected segments form another longer straight segment and wherein none of said segments intersect each other.

In one example, an antenna geometry forming a space-filling curve may include at least five segments, each of the at least five segments forming an angle with each adjacent segment in the curve, at least three of the segments being shorter than one-tenth of the longest free-space operating wavelength of the antenna. Each angle between adjacent segments is less than 180° and at least two of the angles between adjacent sections are less than 115°, and at least two of the angles are not equal. The example curve fits inside a rectangular area, the longest side of the rectangular area being shorter than one-fifth of the longest free-space operating wavelength of the antenna. Some space-filling curves might approach a self-similar or self-affine curve, while some others would rather become dissimilar, that is, not displaying self-similarity or self-affinity at all (see for instance 1510, 1511, 1512).

Preferably, as shown in FIGS. 1 to 6, first conductor 11, 21 is disposed between the second 12, 22 and third conductors 13, 23. Further, as shown in FIGS. 5 and 6, the first and second segments 11*a*, 11*b*, 21*a*, 21*b* have a rectangular shape extended along the most part of the longitudinal dimension of the longitudinal substrate 2, 3. Preferably, these first and second segments 11*a*, 11*b*, 21*a*, 21*b* are oriented in a central part of the first and second surfaces 15, 25, 16, 26 of the longitudinal substrate 2, 3, wherein the central part of the first surface 15, 25 is correspondent to the central part of the second surface 16, 26.

First and second segments 11*a*, 11*b*, 21*a*, 21*b* are connected through a plurality of vias 19, 29 performed at the periphery of said first and second segments 11*a*, 11*b*, 21*a*, 21*b* avoiding thus parasitic capacitances.

In addition, placing the first and second segments 11*a*, 11*b*, 21*a*, 21*b* along the central part of the longitudinal substrate 2, 3 causes that the vias 19, 29 are also placed at the central part of the substrate 2, 3. Preferably, the distance between the vias 19, 29 performed around the periphery of each one of the first and second segments 11*a*, 11*b*, 21*a*, 21*b* of the first conductor 11, 21 are about $\lambda/10$. With this configuration, the invention achieves that vias 19, 29 are not separated enough for arising coupling between them, while covering great part of the substrate 2, 3.

According to another preferred embodiment, the MIMO antenna system 1 further comprises at least one additional antenna coupled to the common dielectric substrate 5 and being selected from the group of: a satellite digital audio radio services (SDARS) antenna, a global navigation satellite system (GNSS) antenna, a digital audio broadcasting (DAB) antenna, and an AM/FM antenna.

Figure 9:
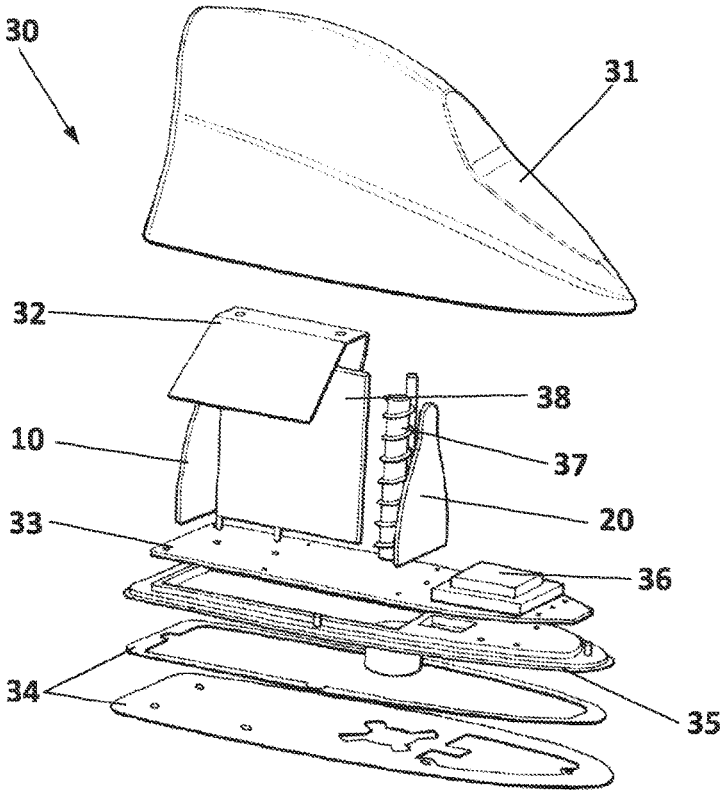
FIG. 9 shows an exploded view of a shark fin antenna comprising the MIMO antenna system of the invention, according to the second embodiment of the invention.

As shown in FIG. 9, a printed circuit board (PCB) 33 comprises the dielectric substrate 5, which constitutes a portable support for holding the MIMO antenna system 1. In addition to the first and second monopole antennas 10, 20, the PCB 33 may further allocate a satellite digital audio radio services (SDARS)/Global navigation satellite system (GNSS) antenna 36, a digital audio broadcasting (DAB) antenna 37, and an AM/FM antenna 38. The PCB 33 can be supported by a metallic base 35 and a rubber sealing 34, which can be adapted to be fixed to a roof of a vehicle.

Thus, an antenna 30 of the shark fin type showed in FIG. 9 comprises a cover 31 enclosing at least the first and second monopole antennas 10, 20, where the MIMO antenna system 1 is adapted to be attached to the vehicle. The shark fin antenna 30 may comprise the MIMO antenna system 1, and all the antennas 10, 20, 36, 37, 38 required for providing all the radio-communication services possibly demanded by the driver. The shark fin antenna 30 integrates these radio-communication services in a single and compact device.

Figure 10:
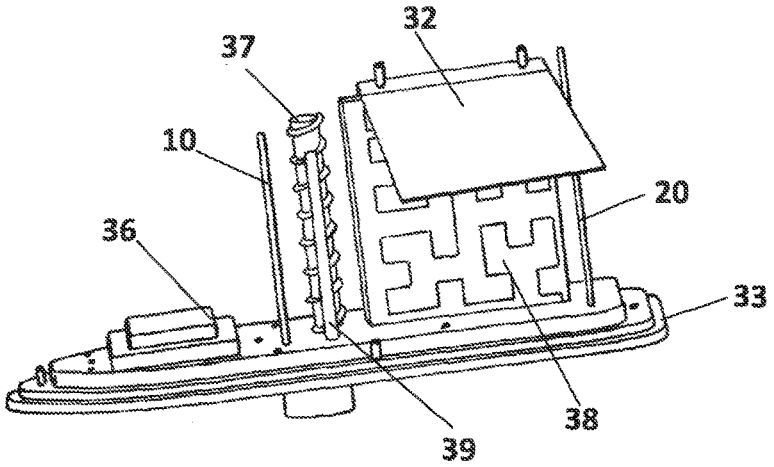
FIG. 10 shows a perspective detailed view of the MIMO antenna system comprising several antennas for providing different radio-communication services, according to the second embodiment of the invention.

FIG. 10 shows a detailed view of the MIMO antenna system 1 shown in FIGS. 5-8, in which the different antennas 10, 20, 36, 37, 38 can be distinguished. As shown, and according to another preferred embodiment, the AM/FM antenna 38 can be a miniaturized antenna and a capacitor 32 can be positioned over said AM/FM miniaturized antenna 38 to simulate the presence of an extended length antenna.

Figure 11:
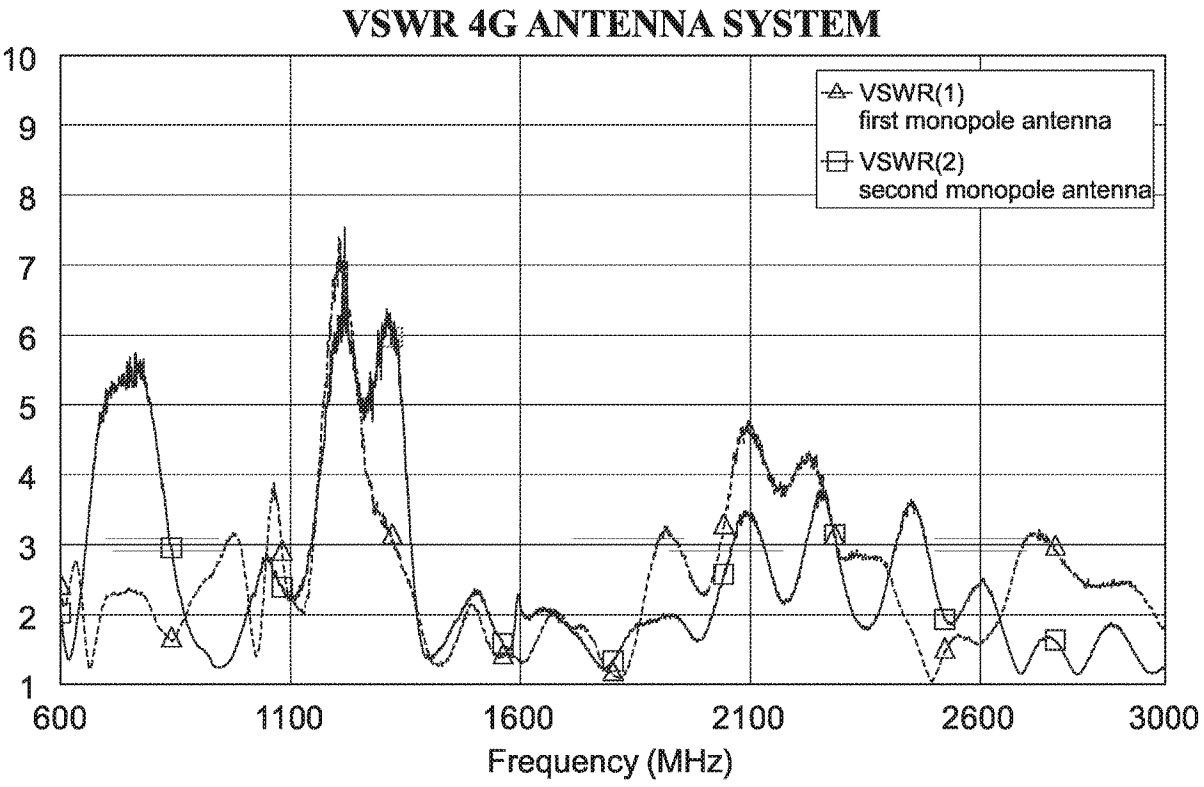
FIG. 11 shows a graphic of the Voltage Standing Wave Ratio (VSWR) of the first and second monopole antenna of the MIMO antenna system.

FIG. 11 shows a graphic of the Voltage Standing Wave Ratio (VSWR) of the first and second monopole antennas 10, 20. As shown, the combination of all operating conductors is achieved on all bands with a value of VSWR<3.

Figure 12:
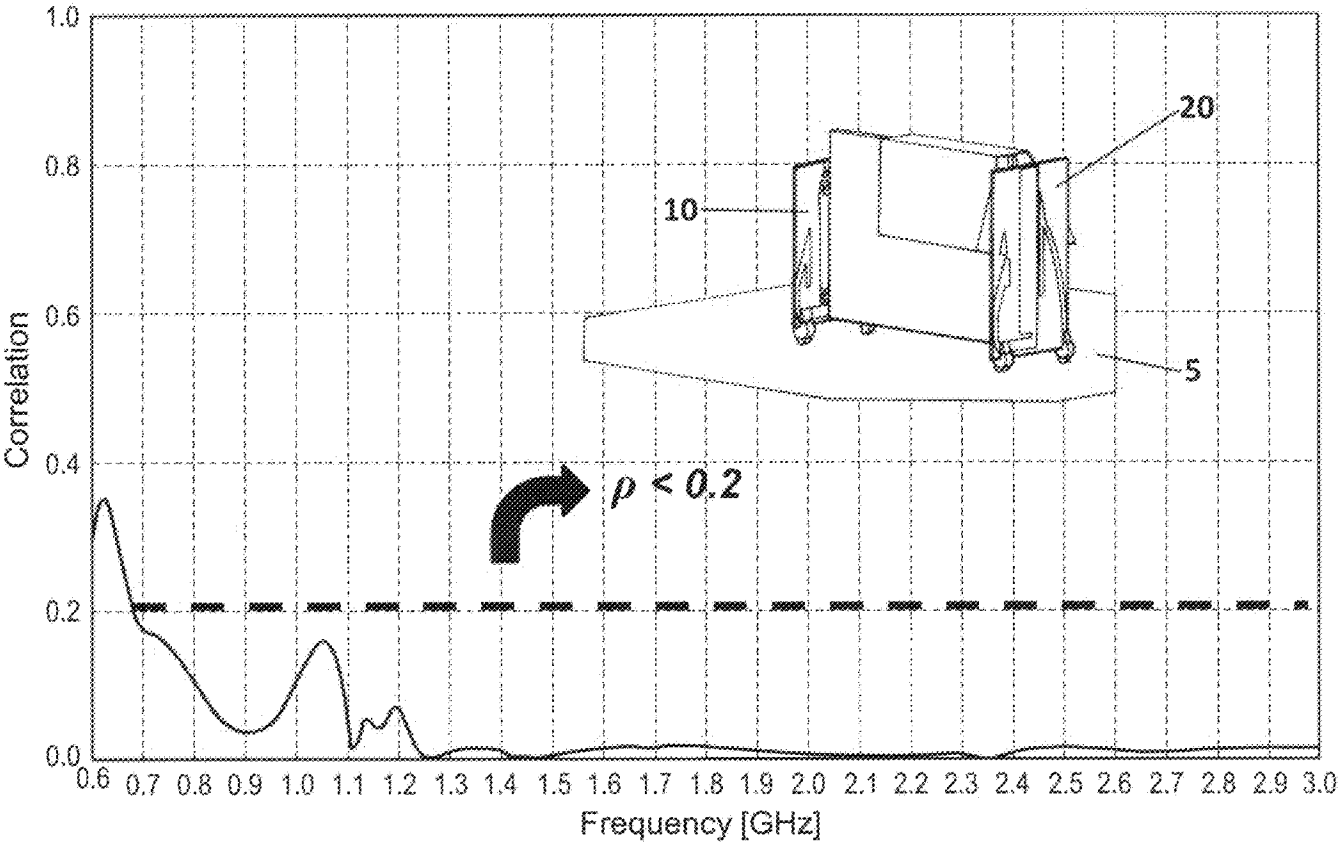
FIG. 12 shows a graphic of the correlation factor of the MIMO antenna system on the far-field.

FIG. 12 shows the correlation factor of the MIMO antenna system 1 on the far-field. As shown, said correlation factor is lower than 0.2 at all LTE frequency bands.

Finally, according to another embodiment, the MIMO antenna system further comprises an electric or electronic device located at a null of the radiation pattern of the MIMO antenna system 1, or at an area where the gain of the MIMO antenna system 1 is at least 5 dB lower than the maximum gain of said MIMO antenna system 1.

Figure 13:
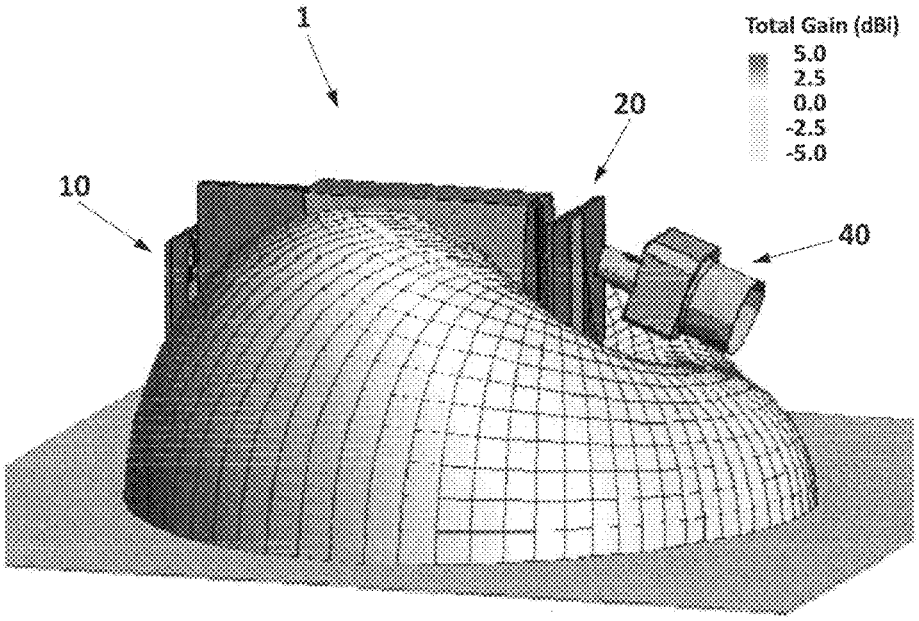
FIG. 13 shows a perspective detailed view of a MIMO antenna system comprising a camera located at a minimum gain of said MIMO antenna system.

Accordingly, FIG. 13 shows a camera located at a point where the gain of the MIMO antenna system 1 is 5 dB lower than the maximum gain of said MIMO antenna system 1. Thus, the invention avoids the need for shielding the radio emissions of the antenna or the electric or electronic component, to ensure proper component operation.

The invention claimed is:

1. A multiple-input multiple-output (MIMO) antenna system for a vehicle comprising first and second monopole antennas disposed on a dielectric substrate, each monopole antenna extending substantially perpendicular to the dielectric substrate, each monopole antenna comprising:

first, second and third conductors, the first and second conductors having an elongated shaped and being electrically connected in parallel to each other, and the third conductor being electromagnetically coupled to the first and second conductors, the first conductor having a height and a thickness such that the height to thickness ratio is comprised within 5 to 45 so as to provide a resonant frequency at a first LTE frequency band, the second conductor having a height of 30%-60% of the height of the first conductor to provide a resonant frequency at a second LTE frequency band, and the third conductor being electromagnetically coupled to the first and second conductors to thereby provide additional resonant frequencies at third and fourth LTE frequency bands and having an electrical length such that an S21 parameter measured as a level of electromagnetic coupling of the third conductor to the first and second conductors in the third and fourth LTE frequency bands is less than −10 dB, where at least one of the monopole antennas has a longitudinal substrate comprising the first, second and third conductors, where the second and third conductors are planar and are extended along a first surface of said longitudinal substrate, and where the first conductor comprises a first segment extended along the first surface of said longitudinal substrate and a second segment extended along a second, opposing surface of said longitudinal substrate, where the first and second segments are connected through a plurality of vias arranged at a periphery of said segments to provide a desired thickness to the first conductor.

2. The MIMO antenna system for a vehicle, according to claim 1, where the distance between the vias of each first and second segments is less than $\lambda/10$, where $\lambda$ is defined by the operation frequency of the first LTE frequency band.

3. The MIMO antenna system for a vehicle, according to claim 2, where said first and second segments have a rectangular shape extended along the major part of the longitudinal dimension of the longitudinal substrate.

4. The MIMO antenna system for a vehicle, according to claim 1, where each one of the first and second monopole antennas have a feeding end and a grounding end, and where first and second feeding points and first and second grounding points are formed on the dielectric substrate to couple the feeding and grounding end to the respective one of the first and second feeding and grounding points.

5. The MIMO antenna system for a vehicle, according to claim 4, where the feeding end is arranged at one extreme of the second conductor, and the grounding end at one extreme of the third conductor.

6. The MIMO antenna system for a vehicle, according to claim 1, where the first and second monopole antennas are disposed on the dielectric substrate such that an imaginary axis passing along the center of the first conductors of the first and second monopole antennas are parallel to each other.

7. The MIMO antenna system for a vehicle, according to claim 1, where a height of the first and second monopole antennas is less than 65 mm.

8. The MIMO antenna system for a vehicle, according to claim 1, where the first conductor of at least one of the first and second monopole antennas is shaped as a space-filling, curve at an extreme portion of the first and second segments.

9. The MIMO antenna system for a vehicle, according to claim 8, where the height of at least one of the first and the second monopole antennas is less than 55 mm.

10. The MIMO antenna system for a vehicle, according to claim 1, where the distance between the first and the second monopole antenna is comprised within 80 and 110 mm.

11. The MIMO antenna system for a vehicle, according to claim 1, where the first conductor is disposed between the second and third conductors.

12. The MIMO antenna system for a vehicle, according to claim 1, further comprising an LC network connected to the first and second conductors to adjust a MIMO antenna system frequency operation.

13. The MIMO antenna system for a vehicle, according to claim 1, further comprising at least one additional antenna coupled to the dielectric substrate, which is selected from the group of: a satellite digital audio radio services (SDARS) antenna, a global navigation satellite system (GNSS) antenna, a digital audio broadcasting (DAB) antenna, and an AM/FM antenna.

14. The MIMO antenna system for a vehicle, according to claim 1, further comprising an electric or electronic device located at an area where the gain of the MIMO antenna system is at least 5 dB lower than the maximum gain of said MIMO antenna system.

15. The MIMO antenna system for a vehicle, according to claim 14, wherein the electric or electronic device is a camera.

16. A shark fin antenna comprising the MIMO antenna system for a vehicle according to claim 1, further comprising a cover for enclosing at least the first and second monopole antennas, where the antenna system is adapted to be attached to the vehicle.

17. A shark fin antenna comprising the MIMO antenna system for a vehicle according to claim 14 or 15, further comprising a cover for enclosing at least the first and second monopole antennas, where the antenna system is adapted to be attached to the vehicle.

* * * * *